US008183791B1

(12) United States Patent
Xiong

(10) Patent No.: US 8,183,791 B1
(45) Date of Patent: May 22, 2012

(54) SYSTEM AND METHOD FOR PREVENTING LOW DIMMING CURRENT STARTUP FLASH

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 397 days.

(21) Appl. No.: 12/605,156

(22) Filed: Oct. 23, 2009

(51) Int. Cl.
*H05B 41/36* (2006.01)

(52) U.S. Cl. ..... 315/291; 315/307; 315/224; 315/308; 315/209 R; 315/DIG. 4

(58) Field of Classification Search ..... 315/224, 315/247, 308, 307, 291, 209 R, DIG. 4, DIG. 5, 315/DIG. 7
See application file for complete search history.

(56) References Cited

U.S. PATENT DOCUMENTS

| | | | | |
|---|---|---|---|---|
| 5,680,017 | A * | 10/1997 | Veldman et al. | 315/308 |
| 5,691,605 | A * | 11/1997 | Xia et al. | 315/307 |
| 6,211,623 | B1 | 4/2001 | Wilhelm et al. | |
| 6,693,393 | B2 * | 2/2004 | Konishi et al. | 315/224 |
| 6,949,888 | B2 * | 9/2005 | Ribarich | 315/291 |
| 7,042,170 | B2 | 5/2006 | Vakil et al. | |
| 7,408,307 | B2 | 8/2008 | Ribarich | |
| 2007/0090775 | A1 | 4/2007 | Ribarich | |

* cited by examiner

*Primary Examiner* — Douglas W Owens
*Assistant Examiner* — Amy Yang
(74) *Attorney, Agent, or Firm* — Waddey & Patterson, P.C.; Mark J. Patterson; Gary L. Montle

(57) ABSTRACT

An electronic ballast is provided for powering a discharge lamp without visible flash at startup. The ballast includes an integrated circuit having at least one inverter drive output and a voltage controlled oscillator input. A first capacitor is coupled to the voltage controlled oscillator input. An oscillating half-bridge inverter is arranged to receive control signals from the drive output and further coupled to the lamp. The integrated circuit is programmed to start up the lamp by: in a first startup time period, maintaining predetermined lamp preheat values; in a second period, charging the first capacitor to a lamp breakdown voltage; in a third period, continuing to charge the first capacitor to a maximum voltage controlled oscillator input voltage; and in a fourth period, discharging the first capacitor to a predetermined lamp steady state value. The first capacitor is further charged during the third time period by a positive differential current conducted from the lamp output and the third time period correspondingly reduced.

20 Claims, 5 Drawing Sheets

SYSTEM AND METHOD FOR PREVENTING LOW DIMMING CURRENT STARTUP FLASH

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic ballasts for powering discharge lamps. More particularly, the present invention relates to ballast circuitry designed to prevent startup flash when a ballast starts up from a low level dimming current.

Dimming electronic ballasts are popular in the lighting market because of their ability to adjust light output levels and save energy. Sometimes if a dimming ballast is not properly designed a light flash may be seen when starting from minimum level dimming. This light flash may be quite annoying to the user.

Referring now to FIG. 1, an electronic ballast 1 having a typical class D inverter topology for powering a fluorescent lamp 12 as known in the prior art is shown. Q1 and Q2 are switching elements, typically MOSFETs, in a half bridge inverter 18. C1 is a DC blocking capacitor. T1 is a resonant inductor, and C2 is a resonant capacitor. C3 is another DC blocking capacitor. A ballast control driver circuit 14 is used to control the operating frequency of the switching elements Q1 and Q2 of the half bridge inverter 18. Usually this driver circuit is an integrated circuit 14, where there is a pin 16 for a voltage controlled oscillator input and a capacitor C4 is connected to this pin 16. The voltage across the capacitor C4 is the input for the voltage controlled oscillator that controls the operating frequency of the half bridge inverter 18.

Referring to FIGS. 2*a*-2*c*, operation of the prior art electronic ballast 1 may be further described. When $0 \leqq t \leqq t1$, voltage controlled oscillator input (V_vco_in) is V_min; integrated circuit output frequency is F_max; and lamp current I_lamp is zero. Typically this period is designated for preheating of the lamp 12.

When $t1 \leqq t \leqq t2$, preheating of the lamp is completed. The integrated circuit 14 will attempt to start the lamp 12. To do so, the integrated circuit 14 will have to reduce the inverter operating frequency by charging up the capacitor C4 until the output voltage reaches the lamp ignition breakdown voltage at t2. At t=t2, the lamp breaks over and current is ready to flow. During this period the lamp current I_lamp is still zero.

When $t2 \leqq t \leqq t3$, the integrated circuit continues charging capacitor C4 until the voltage controlled oscillator input V_vco_in reaches V_max. During this period the frequency continues to decrease and lamp current increases from zero to I_startup_peak.

When $t3 \leqq t \leqq t4$, the integrated circuit starts to discharge capacitor C4 until the lamp current equals the steady state current (I_lamp=I_steady).

Generally the period between t2 and t3 is long (i.e. 10 ms to 50 ms) such that a visible flash will be seen if the steady state current I_steady is very low. Typically the time between t3 and t4 is short because the integrated circuit rapidly discharges the capacitor C4 after the voltage controlled oscillator input V_vco_in reaches V_max. Therefore, the time between t2 and t3 may be the primary cause for the visible flash that occurs during lamp startup.

In light of the previously described problems, it would be desirable to have an electronic ballast that prevents the visible flash at startup under low current dimming conditions.

BRIEF SUMMARY OF THE INVENTION

A system and method are herein presented for preventing the startup flash problem described above.

A differential charging circuit is provided with respect to at least the class D inverter topology as shown in FIG. 1 and operated as shown in FIGS. 2*a*-2*c*. The differential charging circuit is coupled between the lamp and the first capacitor coupled to the voltage controlled oscillator input of the integrated circuit. The differential charging circuit includes a third capacitor, a resistor for limiting the magnitude of the voltage across the first capacitor, and a diode for limiting the differential current applied to the first capacitor to only positive values.

During the time period $t2 \leqq t \leqq t3$, the first capacitor is charged at an increased rate with respect to the rate at which the first capacitor is charged during $t1 < t < t2$. This is due to the differential current supplied across the differential charging circuit, as the lamp begins to charge after the breakdown voltage is reached at t2 and the resultant current is fed back to the first capacitor. As such, the charging time is substantially reduced. The visible flash which occurs during the charging time of the prior art is prevented, as the visible flash time of the present invention is less than the amount of time in which the human eye is able to register the occurring flash.

In a first embodiment of the present invention, an electronic ballast is provided for powering a discharge lamp. The ballast includes a half bridge inverter and a driver circuit. The driver circuit has at least one output for providing inverter drive signals to the half bridge inverter, and also has a driver input. A first capacitor is coupled on a first end to ground, and coupled on a second end to the driver input. A second capacitor is coupled on a first end to ground, and coupled on a second end to the lamp. A differential circuit is coupled on a first end to a node between the first capacitor and the driver input, and coupled on a second end to a node between the second capacitor and the lamp. The differential circuit is further arranged to conduct charging current across the lamp from the second node to the first node. In this manner the differential circuit accelerates a lamp startup charging time for a driver input voltage as measured across the first capacitor.

In a second embodiment of the present invention, an electronic ballast for powering a discharge lamp includes an integrated circuit having at least one inverter drive output and a voltage controlled oscillator input. A first capacitor is coupled to the voltage controlled oscillator input. An oscillating half-bridge inverter is arranged to receive control signals from the inverter drive output and further coupled to the lamp. The integrated circuit is programmed to start up the lamp by: in a first startup time period, maintaining predetermined lamp preheat values; in a second period, charging the first capacitor to a lamp breakdown voltage; in a third period, continuing to charge the first capacitor to a maximum voltage controlled oscillator input voltage; and in a fourth period, discharging the first capacitor until a predetermined lamp steady state value is detected. The first capacitor is further charged during the third time period by a positive differential current conducted from the lamp output, and the third startup time period is correspondingly reduced.

In another embodiment of the present invention, a method is provided of preventing visible flash during startup of a discharge lamp having a current provided by an electronic ballast. The ballast in accordance with the method includes an inverter driver circuit, an oscillating inverter controlled by driver circuit control signals having a frequency, and a first capacitor coupled to the driver circuit. An input voltage for the driver circuit is associated with a voltage across the first capacitor. The method includes a first step of setting the control signal frequency and input voltage at predetermined lamp preheat values for preheating of the lamp. The method includes a second step of charging the first capacitor up to a predetermined lamp breakdown voltage at a first charging rate. The method includes a third step of charging the first capacitor up to a predetermined maximum driver circuit input voltage at a second charging rate associated with a positive differential current supplied to the first capacitor from the lamp. The method further includes a fourth step of discharging the first capacitor until a predetermined lamp steady state value is detected.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Figure 1:
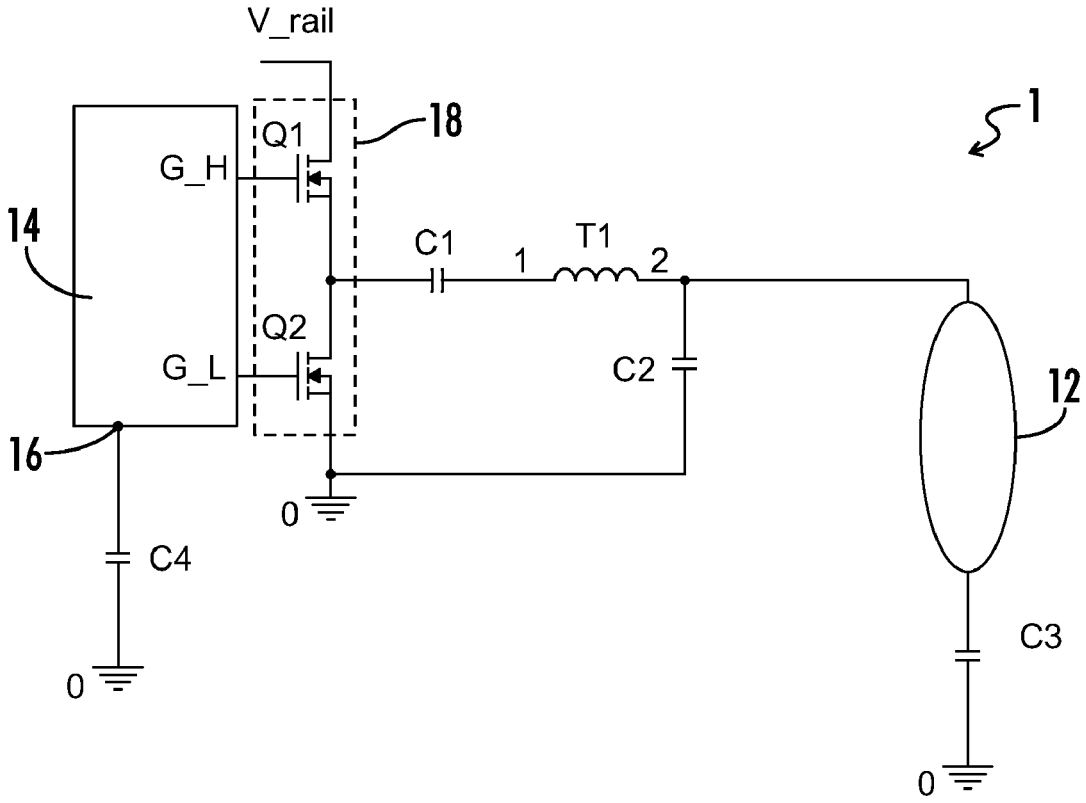
FIG. 1 (PRIOR ART)
FIG. 1 is a circuit diagram for an electronic ballast having an inverter topology for powering a discharge lamp as previously known in the art.
Figure 2A:
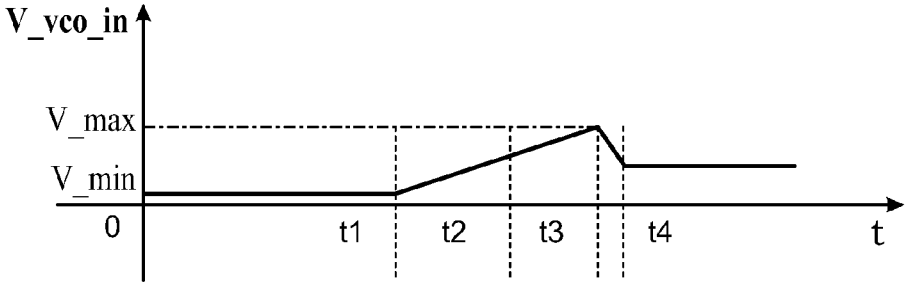
FIG. 2a (PRIOR ART)
FIGS. 2*a*-2*c* graphically illustrate a starting sequence of the electronic ballast of FIG. 1, respectively showing driver input voltage, control signal output frequency and lamp current with respect to time.
Figure 2B:
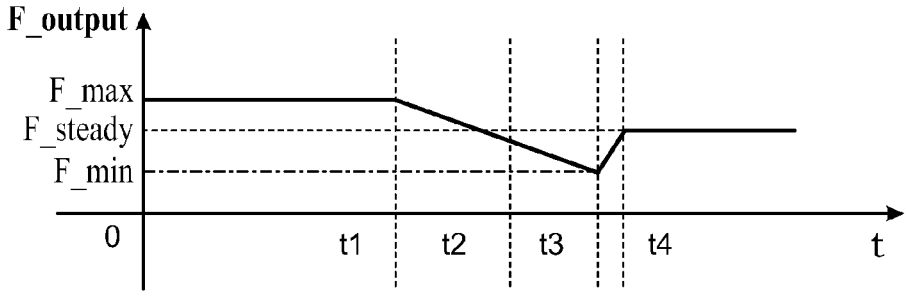
FIG. 2b (PRIOR ART)
Figure 2C:
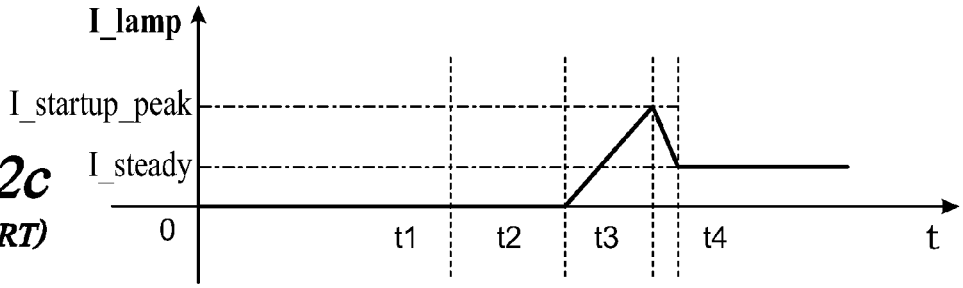
FIG. 2c (PRIOR ART)
Figure 3:
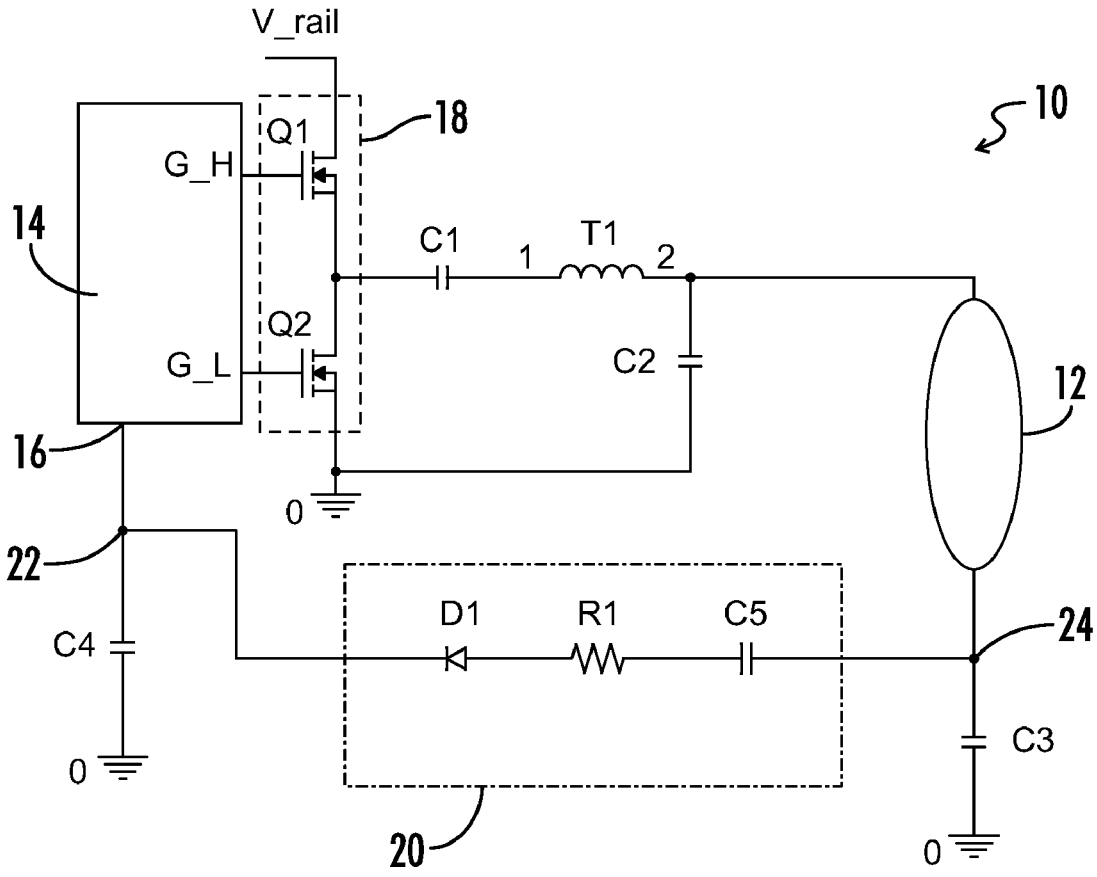
FIG. 3 is a circuit diagram for an embodiment of an electronic ballast of the present invention.
Figure 4:
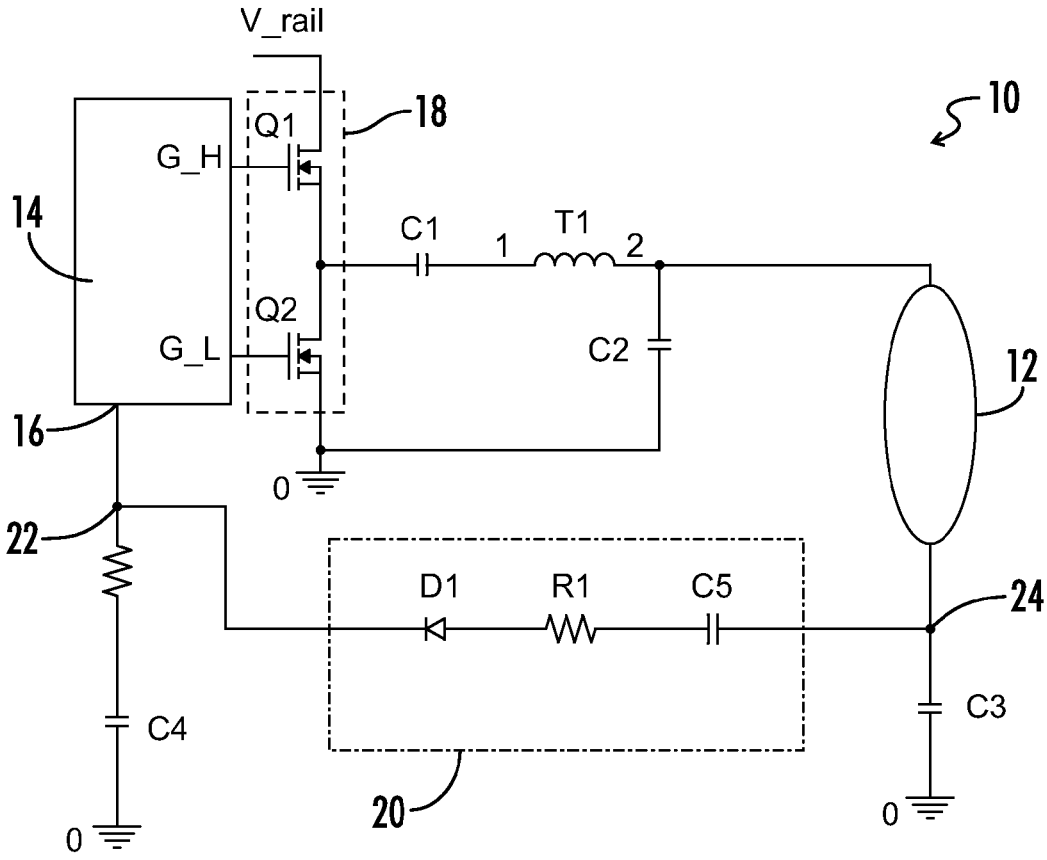
FIG. 4 is a circuit diagram for another embodiment of an electronic ballast of the present invention.
Figure 5A:
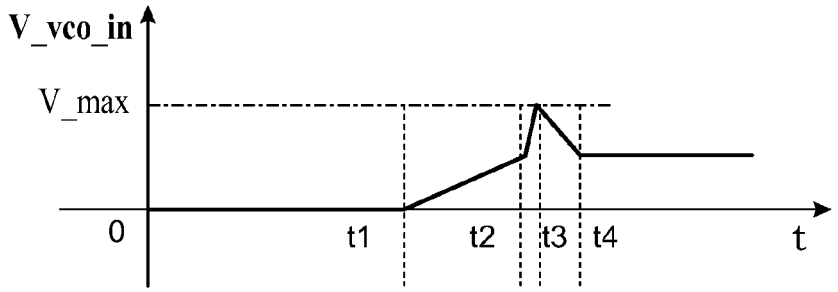
FIGS. 5*a*-5*d* graphically represent a starting sequence of the electronic ballast of FIG. 3, respectively showing driver input voltage, lamp voltage, control signal output frequency and lamp current with respect to time.
Figure 5B:
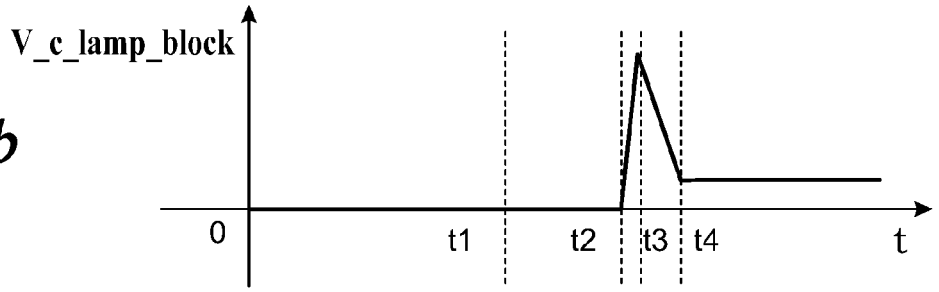
Figure 5C:
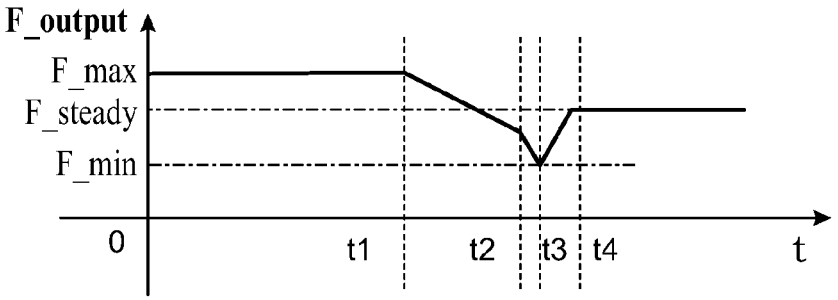
Figure 5D:
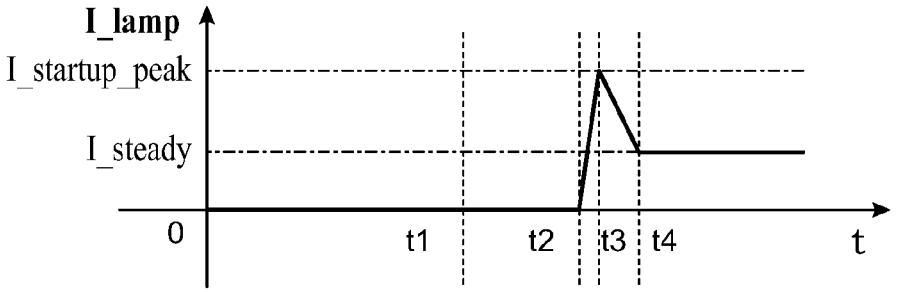

Referring to FIGS. 3-5, an electronic ballast is provided for powering at least one discharge lamp while substantially preventing visible flashes that might otherwise occur during startup. The drawing figures generally demonstrate the electronic ballast as utilizing a particular class D inverter topology as shown in FIG. 1 and as known in the art, but the concepts and methods of the present invention are understood to apply in various equivalent structures as known in the art.

Referring to FIG. 3, an embodiment of an electronic ballast 10 of the present invention is shown. Various features of the ballast 10 are numbered the same and share the same functionality as various features as shown in FIG. 1, and further description is unnecessary here. The embodiment as shown in FIG. 3 further includes a differential charging circuit 20 or feedback circuit 20 coupled on one end to a first node 22 between the first capacitor C4 and the voltage controlled oscillator input 16, and coupled on a second end to a second node 24 between the second capacitor C3 and the lamp 12.

The differential charging circuit 20 in the embodiment shown includes a capacitor C5, a resistor R1 and a diode D1 to couple charging voltage across the capacitor C3 from the second node 24 to the first node 22, and thereby to the voltage controlled oscillator input 16. Alternative configurations of the differential charging circuit 20 are anticipated as being within the scope of the present invention as herein described.

Referring to FIGS. 5*a*-5*d*, operation of an embodiment of the ballast 10 having a differential charging circuit 20 of the present invention may be further described herein.

During a first startup time period ($0<t<t1$) the ballast may be designed to operate in a preheat mode, and the integrated circuit 14 may be programmed to maintain predetermined lamp preheat values. In an embodiment, the voltage controlled oscillator input voltage V_vco_in is V_min. The output frequency of driver signals provided by the integrated circuit 14 is F_max, and the lamp current I_lamp is zero.

During a second startup time period ($t1<t<t2$) the ballast 10 may attempt to ignite the lamp 12. The integrated circuit 14 may be programmed to begin charging the first capacitor C4 until the voltage controlled oscillator input voltage V_vco_in, which is associated with the voltage across the first capacitor C4, reaches a breakdown voltage for the lamp 12. The driver signal frequency also drops in association with the voltage rise across the first capacitor C4. The lamp current I_lamp during this time period remains zero, but once the voltage across the first capacitor C4 reaches the breakdown voltage of the lamp 12, the lamp breaks over and begins to conduct current.

During a third startup time period ($t2<t<t3$) the integrated circuit 14 may be programmed to continue charging the first capacitor C4, and the driver output frequency F_out continues to drop. However, in this period the second capacitor C3 may also charge extremely rapidly from zero to some value as the lamp current I_lamp charges from zero to a lamp startup peak current I_startup_peak. Capacitor C5 of the differential charging circuit 20 differentiates the voltage across second capacitor C3 and feeds back the differential signal to the first capacitor C4. Diode D1 may be provided to limit the signal applied across the differential charging circuit 20 to a positive feedback signal to charge the first capacitor C4. A resistor R1 may be provided to limit the voltage amplitude across the first capacitor C4.

The rate at which the first capacitor C4 charges during the second time period may be described as a first charging rate. The rate at which the driver output frequency F_out drops is further associated with the first charging rate. The rate at which the first capacitor C4 charges during the third time period may be described as a second charging rate, which is increased with respect to the first charging rate due to the feedback signal from the differential charging circuit 20. The increased rate of change from the first charging rate to the second charging rate is associated with the positive differential signal supplied to the first capacitor C4. The rate at which the driver output frequency F_out drops during the third time period is further increased with respect to the rate of drop from the second time period.

As a result of the differential charging circuit 20, the first capacitor C4 may be charged up much more rapidly to a predetermined maximum voltage controlled oscillator input voltage V_max. At least in part because of this additional feedback differential charging current, the time period between t2 and t3 may be reduced greatly. The flash that otherwise occurs during startup may therefore be invisible if the time period is correspondingly too short for human eyes to realize.

During a fourth startup time period (t3<t<t4) the integrated circuit 14 may be programmed to begin discharging the first capacitor C4. The driver output frequency F_out rises in association with the voltage drop across the first capacitor C4, and the lamp current I_lamp correspondingly drops. When the lamp current I_lamp reaches a predetermined steady state value, the integrated circuit 14 stops discharging the first capacitor C4 and the fourth time period ends at time t4.

After the fourth startup time period, the lamp 12 operates in steady state. The voltage across the second capacitor C3 is generally very small since the second capacitor C3 is preferably very large in value. In a particular embodiment the value of the second capacitor C3 is about 220 nF. The differential charging circuit 20 does not conduct from the second node 24 to the first node 22, at least in part because of the small amount of voltage at the second node 24.

Referring now to FIG. 4, in an embodiment a resistor R2 may be coupled in series between the first node 22 and the first capacitor C4. The value of resistor R2 may be selected to further accelerate the time transient between t2 and t3, thereby further reducing the potential for a visible flash during startup of the lamp 12.

In alternative embodiments the half bridge inverter may instead receive control signals from a driver circuit 14 that is not necessarily an integrated circuit or microprocessor. The charging and discharging of the first capacitor C4 may in such embodiments be triggered by a separate circuit within the scope of the present invention, with the voltage across the first capacitor C4 continuing to be input to the driver circuit 14 as a reference for modulation of the driver output signal frequency V_out.

The previous detailed description has been provided for the purposes of illustration and description. Thus, although there have been described particular embodiments of the present invention of a new and useful "System and Method for Preventing Low Dimming Current Startup Flash," it is not intended that such references be construed as limitations upon the scope of this invention except as set forth in the following claims.

What is claimed is:

1. An electronic ballast comprising:

an inverter for powering a discharge lamp;

a driver circuit further comprising at least one output for providing inverter drive signals to the inverter and a driver input;

a first capacitor coupled on a first end to ground, and coupled on a second end to the driver input;

a second capacitor coupled on a first end to ground, and coupled on a second end to the lamp; and a differential charging circuit coupled on a first end to a node between the first capacitor and the driver input and coupled on a second end to a node between the second capacitor and the lamp, the charging circuit arranged to conduct a positive differential signal from the second node to the first node;

wherein said charging circuit accelerates a lamp startup charging time for a driver input voltage as measured across the first capacitor.

2. The ballast of claim 1, the driver circuit further comprising an integrated circuit, the driver input further comprising a voltage controlled oscillator input.

3. The ballast of claim 1, further comprising a first resistor coupled between the first capacitor and the driver input for further accelerating the lamp startup charging time.

4. The ballast of claim 1, the lamp startup charging time having a first charging rate from a minimum driver input voltage to a breakdown voltage of the lamp.

5. The ballast of claim 4, the lamp startup charging time having a second charging rate from the breakdown voltage of the lamp to a maximum driver input voltage, wherein the second charging rate is increased with respect to the first charging rate in association with the additional current provided by the charging circuit to the first capacitor.

6. The ballast of claim 5, the charging circuit further comprising a third capacitor, and a resistor for limiting the voltage amplitude across the first capacitor.

7. The ballast of claim 6, the charging circuit further comprising a diode for limiting the current applied by the charging circuit to a positive differential current from the lamp.

8. An electronic ballast for powering a discharge lamp, the ballast comprising:

an integrated circuit having at least one inverter drive output and a voltage controlled oscillator input;

a first capacitor coupled to the voltage controlled oscillator input;

an oscillating half-bridge inverter arranged to receive control signals from the inverter drive output and further coupled to the lamp, the integrated circuit programmed to start up the lamp by in a first startup time period, maintaining predetermined lamp preheat values, in a second period, charging the first capacitor to a lamp breakdown voltage, in a third period, continuing to charge the first capacitor to a maximum voltage controlled oscillator input voltage, and in a fourth period, discharging the first capacitor until a predetermined lamp steady state value is detected, wherein the first capacitor is further charged during the third time period by a positive feedback signal conducted from the lamp output and the third startup time period correspondingly reduced.

9. The ballast of claim 8, wherein the first capacitor charges in the second time period at a first charging rate, and wherein the first capacitor charges in the third time period at a second charging rate, the second charging rate increased with respect to the first charging rate in light of the positive feedback signal from the lamp.

10. The ballast of claim 9, the lamp preheat values further comprising a minimum voltage controlled oscillator input voltage and a maximum control signal frequency.

11. The ballast of claim 10, wherein the control signal frequency is decreased in the second time period at a rate associated with the first charging rate of the first capacitor.

12. The ballast of claim 11, wherein the control signal frequency is decreased in the third time period at a rate associated with the second charging rate of the first capacitor.

13. The ballast of claim 12, the feedback signal provided by a feedback circuit coupled between a lamp output and the first capacitor.

14. The ballast of claim 13, the feedback circuit further comprising a second capacitor, a resistor for limiting the magnitude of the voltage across the first capacitor and a diode for limiting the differential signal to a positive signal with respect to the first capacitor.

15. A method of preventing visible flash during startup of a discharge lamp, said lamp having a current provided by an electronic ballast comprising an inverter driver circuit, an oscillating inverter controlled by driver circuit control signals having a frequency, and a first capacitor coupled to said driver circuit, an input voltage for said driver circuit associated with a voltage across said first capacitor, said method comprising:

(a) setting said control signal frequency and input voltage at predetermined lamp preheat values for preheating of said lamp;

(b) charging said first capacitor up to a predetermined lamp breakdown voltage at a first charging rate;

(c) charging said first capacitor up to a predetermined maximum driver circuit input voltage at a second charging rate, said second charging rate associated with a positive feedback signal supplied to said first capacitor from said lamp; and (d) discharging said first capacitor until a predetermined lamp steady state value is detected.

16. The method of claim 15, said lamp preheat values further comprising a minimum driver circuit input voltage and a maximum control signal frequency.

17. The method of claim 16, wherein step (b) further comprises decreasing the control signal frequency at a rate associated with the first charging rate of the first capacitor.

18. The method of claim 17, wherein step (c) further comprises decreasing the control signal frequency at a rate associated with the second charging rate of the first capacitor.

19. The method of claim 18, the positive differential current provided by a differential circuit coupled between a lamp output and the first capacitor, the differential circuit further comprising a capacitor, a resistor and a diode connected in series.

20. The method of claim 19, wherein a first time period for performing step (c) is reduced below a second time period wherein a flash is visible to the human eye.

* * * * *